US009947193B2

(12) United States Patent
Barkan et al.

(10) Patent No.: US 9,947,193 B2
(45) Date of Patent: Apr. 17, 2018

(54) ELECTRONIC ARTICLE SURVEILLANCE (EAS) ASSEMBLY INSTALLABLE IN PRODUCT PROCESSING WORKSTATION, AND METHOD OF INSTALLATION

(71) Applicant: SYMBOL TECHNOLOGIES, LLC, Lincolnshire, IL (US)

(72) Inventors: Edward D. Barkan, Miller Place, NY (US); Mark E. Drzymala, Saint James, NY (US)

(73) Assignee: Symbol Technologies, LLC, Holtsville, NY (US)

( * ) Notice: Subject to any disclaimer, the term of this patent is extended or adjusted under 35 U.S.C. 154(b) by 67 days.

(21) Appl. No.: 15/132,391

(22) Filed: Apr. 19, 2016

(65) Prior Publication Data

US 2017/0301204 A1 Oct. 19, 2017

(51) Int. Cl.

| | |
|---|---|
| ***G08B 13/14*** | (2006.01) |
| ***G08B 13/24*** | (2006.01) |
| ***G07G 1/00*** | (2006.01) |
| ***G07G 3/00*** | (2006.01) |

(52) U.S. Cl.
CPC ..... *G08B 13/2434* (2013.01); *G07G 1/0054* (2013.01); *G07G 3/003* (2013.01); *G08B 13/244* (2013.01); *G08B 13/246* (2013.01)

(58) Field of Classification Search
CPC ..... G08B 13/2434; G08B 13/244
USPC ..... 340/572.8
See application file for complete search history.

(56) References Cited

U.S. PATENT DOCUMENTS

| | | | | |
|---|---|---|---|---|
| 5,376,923 | A * | 12/1994 | Kindschy | G08B 13/2411 340/551 |
| 5,917,412 | A * | 6/1999 | Martin | G08B 13/242 340/572.3 |
| 7,132,947 | B2 * | 11/2006 | Clifford | G07G 1/0045 340/572.3 |
| 8,890,693 | B2 * | 11/2014 | Yang | G08B 13/2411 340/572.3 |
| 2006/0208894 | A1 * | 9/2006 | Friend | G06K 7/0008 340/572.3 |
| 2007/0063045 | A1 * | 3/2007 | Acosta | G06K 7/10693 340/572.3 |

FOREIGN PATENT DOCUMENTS

| | | | |
|---|---|---|---|
| EP | 2461423 | A1 | 6/2012 |
| EP | 2482261 | A2 | 8/2012 |
| WO | 98/53435 | A1 | 11/1998 |

OTHER PUBLICATIONS

International Search Report and Written Opinion for International Patent Application No. PCT/US2017/024783 dated Jul. 10, 2017.

* cited by examiner

*Primary Examiner* — Eric M Blount
(74) *Attorney, Agent, or Firm* — Yuri Astvatsaturov

(57) ABSTRACT

An electronic article surveillance (EAS) assembly is installable in a workstation that processes products associated with targets to be electro-optically read. The assembly includes a radio frequency (RF) antenna having a pair of RF feed lines and a conductive loop for generating an electromagnetic field to deactivate EAS tags associated with the products to be processed, and a protective carrier for supporting and protecting the antenna during the installation in a predetermined position in the workstation.

17 Claims, 10 Drawing Sheets

ELECTRONIC ARTICLE SURVEILLANCE (EAS) ASSEMBLY INSTALLABLE IN PRODUCT PROCESSING WORKSTATION, AND METHOD OF INSTALLATION

BACKGROUND OF THE INVENTION

The present disclosure relates generally to a point-of-transaction, checkout workstation through which retail products associated with electro-optically readable targets, such as bar code symbols, are passed and processed, and, more particularly, to installing an electronic article surveillance (EAS) assembly in the workstation for deactivating EAS tags associated with the products to be processed.

In the retail industry, it is known to read targets, such as one-dimensional bar code symbols, particularly of the Universal Product Code (UPC) type, and two-dimensional bar code symbols, such as Quick Response (QR) codes, associated with, or borne on, retail products that are passed through, and processed by, various types of workstations, such as a flat bed scanner having a single horizontal window, or a vertical slot scanner having a single upright window, or a bi-optical scanner having dual horizontal and upright windows. Each such workstation can have either laser-based or imager-based readers for reading the targets passed by, or presented to either or both windows, and is typically installed in a checkout counter. For products that are sold on the basis of their weight, such as fruits, vegetables, meats, cheeses, nuts, fish, bakery items, candies, etc., it is known to incorporate a weighing scale into the workstation. A horizontal platform of the scale supports the horizontal window.

To prevent shoplifting or unauthorized removal of the retail products, electronic article surveillance (EAS) tags or labels are sometimes associated with, or attached to, the products to be processed. A separate EAS deactivator may be mounted on the counter adjacent the workstation and operated by a clerk to deactivate or remove the EAS tags when the product is properly purchased and checked out, or the EAS deactivator may be integrated into the workstation itself to accelerate checkout and alleviate shopper delays by simultaneously reading the symbols and deactivating the EAS tags. The EAS deactivator includes a radio frequency (RF) antenna having a pair of RF feed lines and a single conductive loop for generating an electromagnetic field of sufficient strength to rapidly and reliably deactivate the EAS tags. The conductive loop is installed inside the workstation, typically around the window and/or the scale of the workstation, and the feed lines are routed from the interior loop to the exterior of the workstation for connection to an EAS controller.

Some manufacturers install the EAS antenna during manufacture of each and every workstation, but this is not desirable, and an unnecessary expense, for those retailers who do not want the EAS deactivator. Other manufacturers ship the EAS antenna as a separate item to any retailer who orders it. Although cost-effective, that retailer is now responsible for installing the EAS antenna, and experience has shown that traditional installation has a high potential for failure, especially when performed by unskilled and impatient personnel. The antenna is typically constituted of a flexible wire, e.g., 20AWG, and it is somewhat difficult to handle and position the flexible loop around the window and/or the scale inside the workstation, and to route the flexible feed lines exteriorly of the workstation. The wire can become pinched in, or can rest on a load cell of, the scale, thereby resulting in erroneous weight measurements. Parts of the workstation need to be removed to gain access to its interior, and the wire can become pinched between the returning parts. Failure of a removed window, for example, from sitting in its proper plane due to a pinched wire can cause not only internal light reflections, and perhaps scrapping of some of the workstation's component parts, but also, can cause air, dust, moisture, and like contaminants to leak into the workstation and interfere with its reading performance.

Accordingly, it would be desirable to rapidly, reliably, and easily install an EAS antenna in a workstation even by unskilled personnel without tools and without damaging the antenna and/or the workstation.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
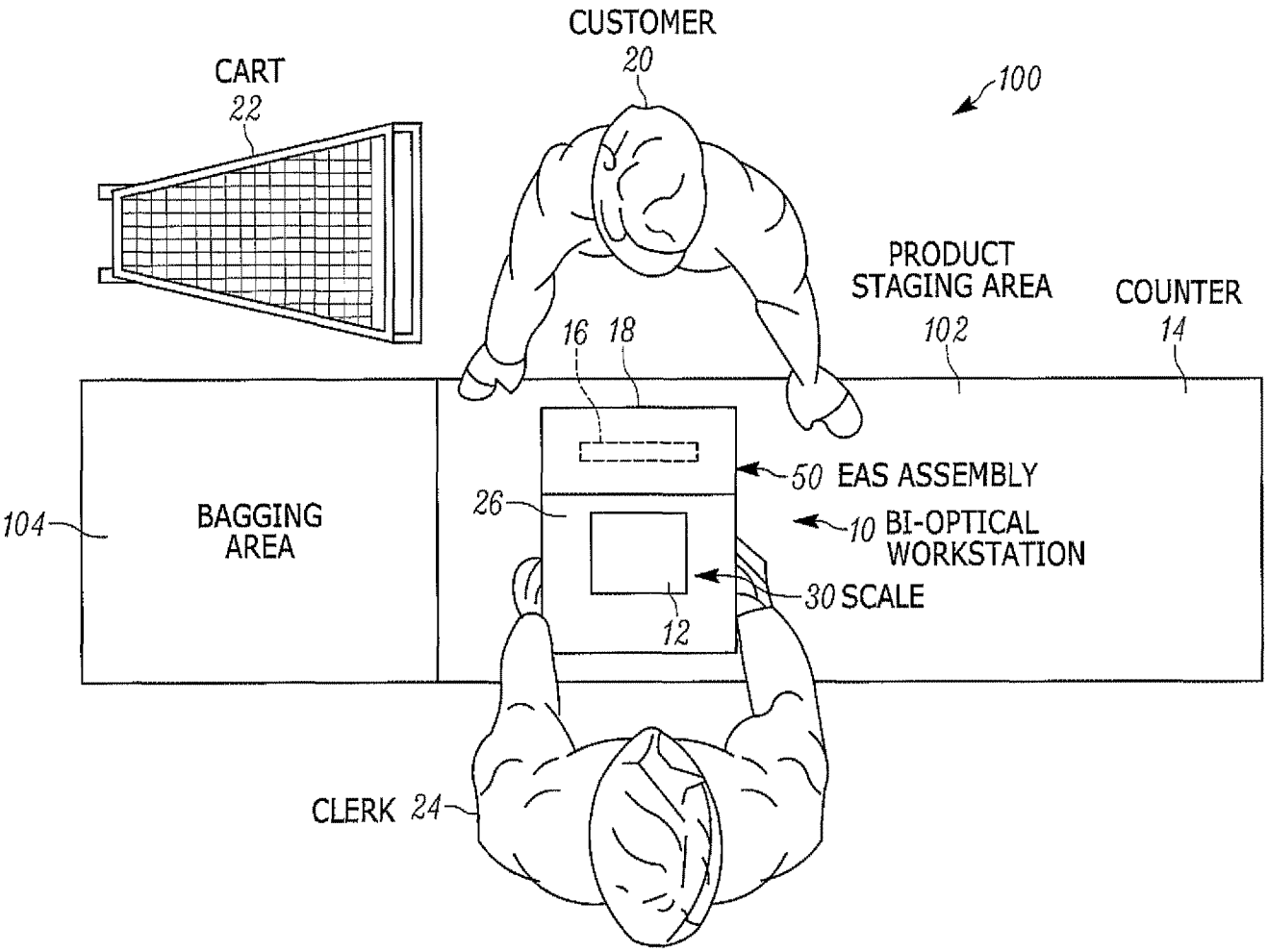
FIG. 1 is a schematic, overhead view of a bi-optical workstation at a retail checkout counter, the workstation being equipped with a weighing scale and being installed with an EAS assembly in accordance with the present disclosure.

Skilled artisans will appreciate that elements in the figures are illustrated for simplicity and clarity and have not necessarily been drawn to scale. For example, the dimensions and locations of some of the elements in the figures may be exaggerated relative to other elements to help to improve understanding of embodiments of the present invention.

The method, workstation, and assembly components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

One aspect of the present disclosure generally relates to a workstation and to an electronic article surveillance (EAS) assembly for installation in the workstation that processes products associated with targets to be electro-optically read. The assembly includes a radio frequency (RF) antenna having a pair of RF feed lines and a conductive loop for generating an electromagnetic field to deactivate EAS tags associated with the products to be processed, and a protective carrier for supporting and protecting the antenna during the installation in a predetermined position in the workstation.

Advantageously, the workstation has one or more light-transmissive windows through which the targets are electro-optically read, and/or a weighing scale for weighing the products. The carrier has a pair of guides of complementary contour to the feed lines for supporting the feed lines, and a guard of complementary contour to the loop for supporting the loop. The loop and the guard surround one or more of the windows and/or the scale in the predetermined position, and the feed lines and the guides extend outwardly of the housing in the predetermined position.

Still another aspect of the present disclosure relates to a method of installing the EAS assembly in the workstation. The method is performed by configuring the RF antenna with the pair of RF feed lines and the conductive loop for generating the electromagnetic field to deactivate the EAS tags associated with the products to be processed, by supporting and protecting the antenna with a protective carrier to constitute the EAS assembly, and by installing the EAS assembly in a predetermined position in the workstation.

In accordance with this disclosure, the antenna is protected at all times by the carrier. The antenna is protected all during storage, transport, installation, removal, and re-installation, if necessary. The flexible wire of the antenna no longer presents any difficulty during installation due to the more rigid support provided by the carrier. The wire no longer can become pinched in, or rest on a load cell of, the scale, or become pinched between returned parts of the workstation. Air, dust, moisture, and like contaminants are prevented from leaking into the workstation and interfering with its reading performance. The EAS antenna installation can be reliably, rapidly, and easily performed by unskilled personnel without tools and without damaging the antenna and/or the workstation.

Figure 2:
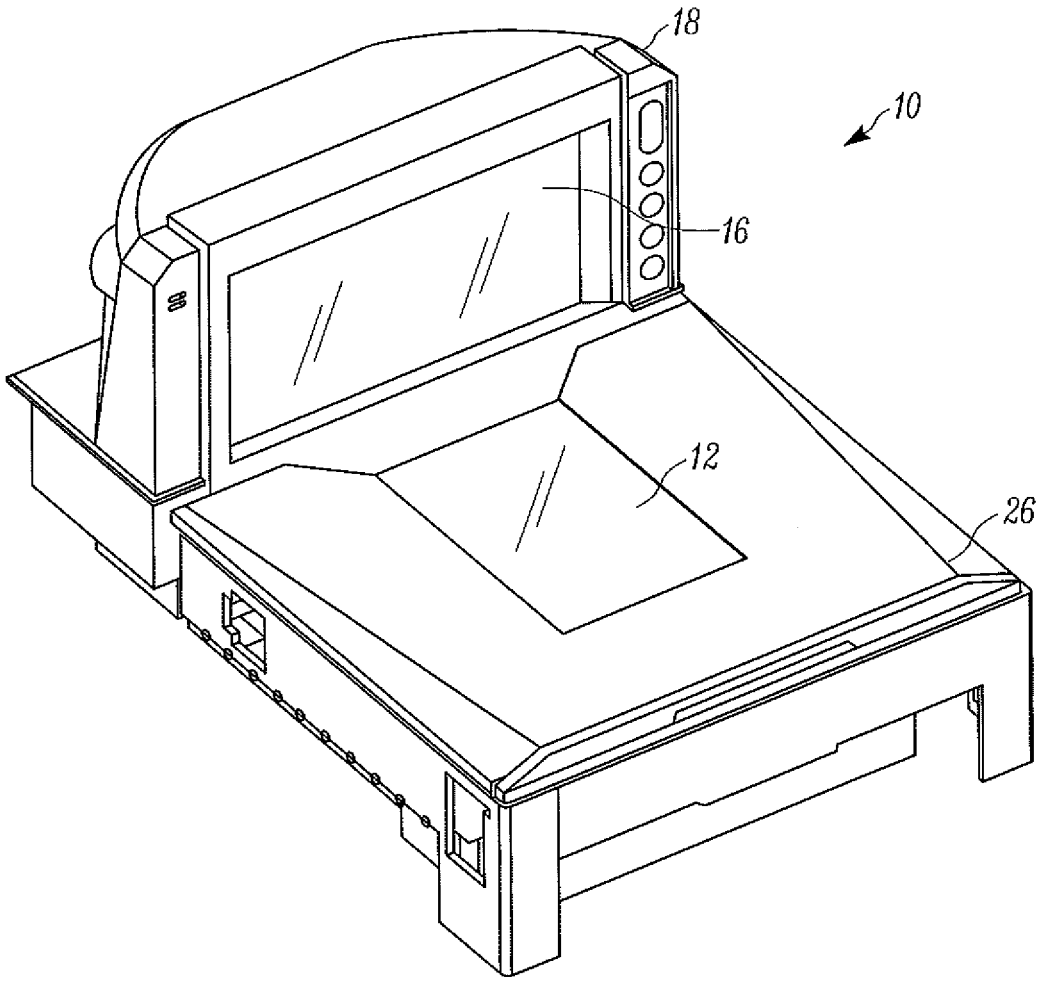
FIG. 2 is a perspective, more realistic view of the workstation of FIG. 1 in isolation.

Turning now to the drawings, a retail checkout 100, as depicted in FIG. 1, includes a dual window, multi-plane, bi-optical, point-of-transaction, retail workstation 10 used by retailers at a retail checkout counter 14 in an aisle to process transactions involving the purchase of retail products associated with, or bearing, an identifying target, such as the UPC symbol described above. In a typical retail venue, a plurality of such workstations 10 is arranged in a plurality of checkout aisles. As best seen in FIG. 2, the workstation 10 has a generally horizontal, planar, bed window 12 supported by a horizontal bed 26. The bed window 12 is either elevated, or set flush, with the counter 14. A vertical or generally vertical, i.e., slightly tilted, (referred to as "upright" hereinafter) planar, tower window 16 is set flush with, or, as shown, recessed into, a raised tower portion 18 above the counter 14. The workstation 10 either rests directly on the counter 14, or preferably, rests in a cutout or well formed in the counter 14. Both the bed and tower windows 12, 16 are typically positioned to face and be accessible to a clerk 24 (FIG. 1) standing at one side of the counter 14 for enabling the clerk 24 to interact with the workstation 10. Alternately, in a self-service checkout, the bed and tower windows 12, 16 are typically positioned to face and be accessible to a customer 20.

FIG. 1 also schematically depicts that a weighing scale 30 is incorporated in the workstation 10. Typically, the bed window 12 is mounted in, and supported by, a platform of the scale 30. As described above, the scale 30 is used to weigh those products, such as fruits, vegetables, meats, cheeses, nuts, fish, bakery items, candies, etc., whose price is a function of their weight. A product staging area 102 is located on the counter 14 at one side of the workstation 10. The products are typically placed on the product staging area 102 by the customer 20 standing at the opposite side of the counter. The customer 20 typically retrieves the individual products for purchase from a shopping cart 22 or basket for placement on the product staging area 102. A non-illustrated conveyor belt could be employed for conveying the products to the clerk 24.

The workstation 10 has a data capture arrangement, for example, a plurality of imaging readers, each including a solid-state imager for capturing light passing through either or both windows 12, 16 from a target that can be a one- or two-dimensional symbol. In typical use, the clerk 24 may weigh any product requiring weighing with the scale 30, and processes each product bearing a UPC symbol thereon, past the windows 12, 16 by swiping the product across a respective window, or by presenting the product by holding it momentarily steady at the respective window, before passing the product to a bagging area 104 that is located at the opposite side of the workstation 10. The symbol may be located on any of the top, bottom, right, left, front and rear, sides of the product, and at least one, if not more, of the imagers will capture the light returning from the symbol through one or both windows 12, 16 as an image.

Figure 3:
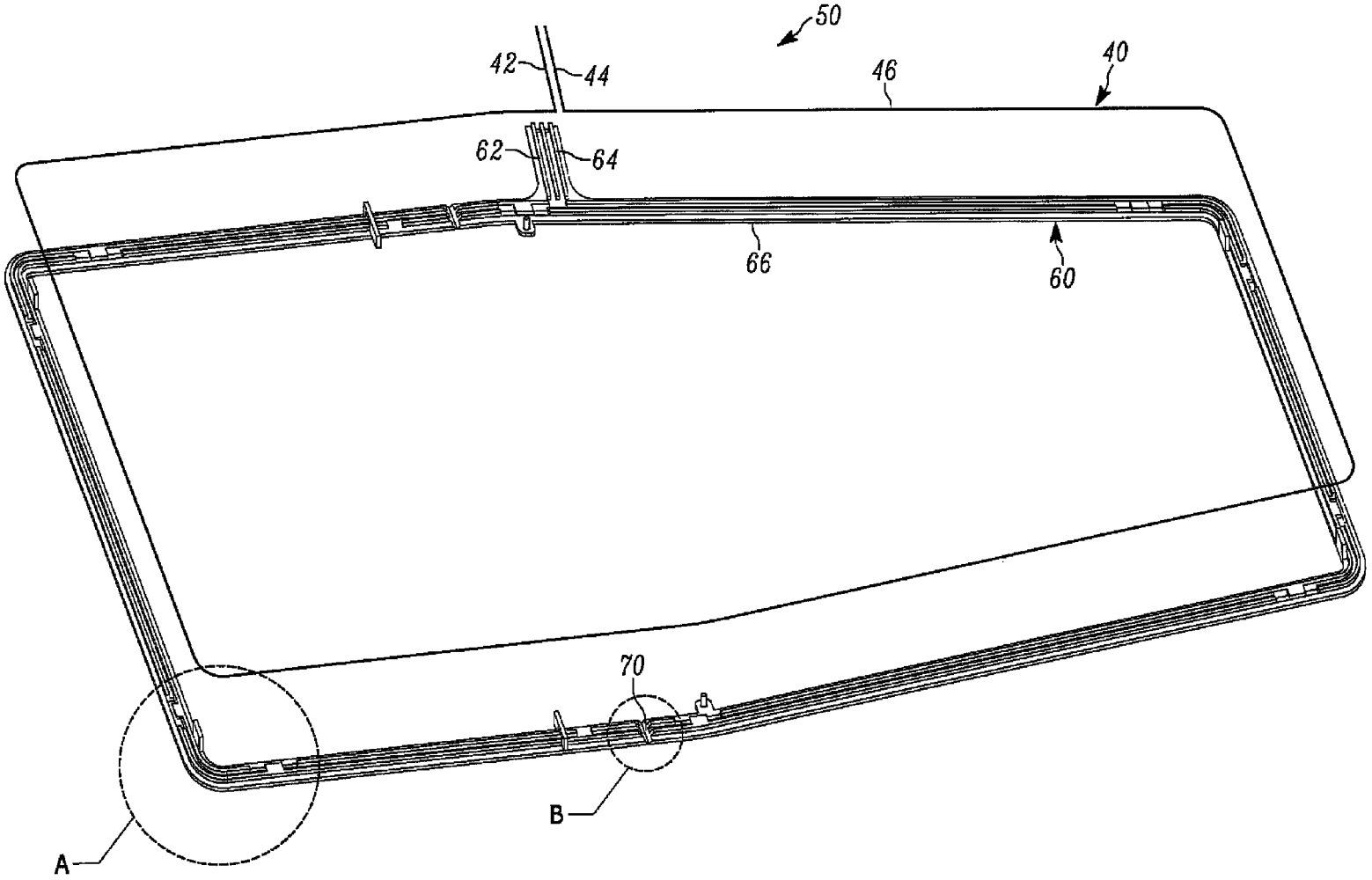
FIG. 3 is a perspective, exploded, enlarged view of the EAS assembly in isolation for installation in the workstation of FIG. 2.

In accordance with this disclosure, an electronic article surveillance (EAS) assembly 50 (see FIG. 3) is installable, as described below, in a predictable, repeatable, predetermined position in the workstation 10. Although the workstation 10 has been illustrated as a dual-window workstation, it will be understood that the EAS assembly 50 could be installed in other types of workstations, for example, a flat bed scanner having a single horizontal window, or a vertical slot scanner having a single upright window. The EAS assembly 50 includes a radio frequency (RF) antenna 40 having a pair of RF transmission or feed lines 42, 44 and a conductive loop 46 for generating an electromagnetic field to deactivate EAS tags associated with the products to be processed, and a protective carrier 60 having a pair of guides 62, 64 of complementary contour to the feed lines 42, 44 for supporting the feed lines 42, 44, and a guard 66 of complementary contour to the loop 46 for supporting the loop 46.

Figure 4:
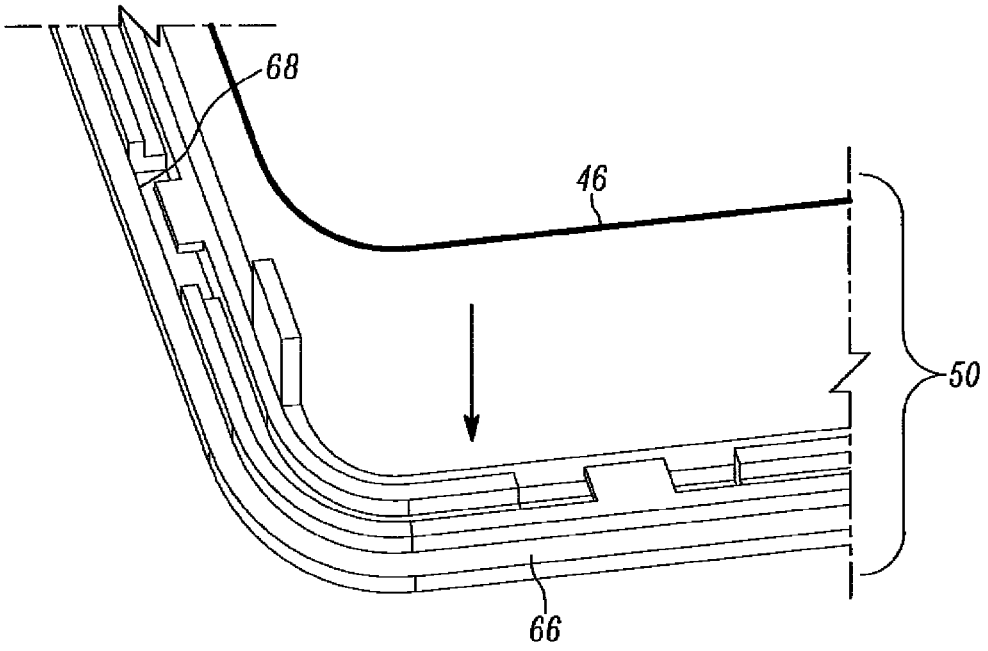
FIG. 4 is a perspective, exploded, enlarged view of the circular area "A" of FIG. 3.
Figure 5:
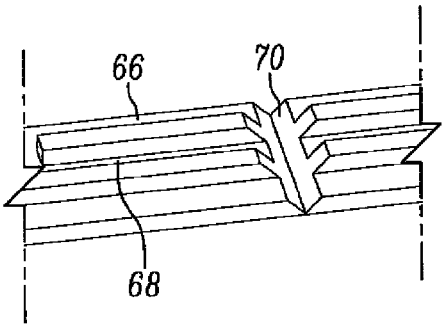
FIG. 5 is a perspective, enlarged view of the circular area "B" of FIG. 3.

The feed lines 42, 44 and the loop 46 are constituted of a one-piece, flexible conductor, e.g., a metal wire of approximately 20 AWG (American Wire Guage), with the loop 46 extending continuously between respective ends of the feed lines 42, 44. The feed lines 42, 44 extend generally linearly away from the loop 46. Although the loop 46 is illustrated as having a generally rectangular contour, it will be understood that the loop 46 may have other contours, such as generally circular, oval, or other polygonal shapes. The guides 62, 64 and the guard 66 of the carrier 60 are integrally constituted of an inflexible material, such as a rigid or semi-rigid, preferably resilient, molded plastic material, with the guard 66 extending continuously between respective ends of the guides 62, 64. The guides 62, 64 extend generally linearly away from the guard 66. Although the guard 66 is illustrated as having a generally rectangular contour, it will be understood that the guard 66 may have other contours, such as generally circular, oval, or other polygonal shapes, but will always follow the contour of the loop 46. The carrier 60 has a groove 68 (see FIG. 4) extending continuously along the guides 62, 64 and the guard 66. The antenna 40 is received with a friction-fit, and snugly and tightly held, in the groove 68, and is protected from damage and being pinched by the stronger, harder material of the carrier 60.

Figure 6:
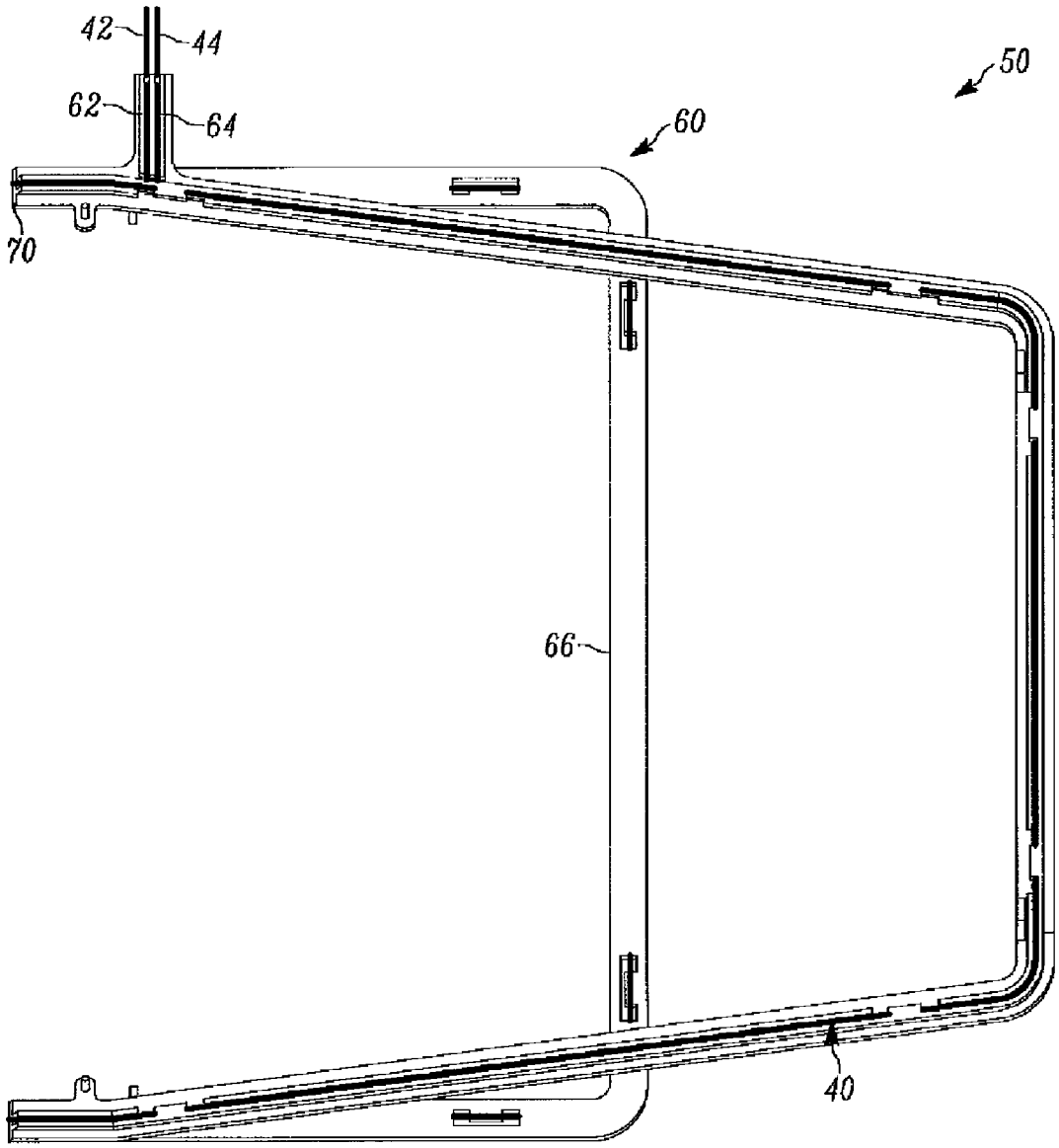
FIG. 6 is a perspective, overhead, enlarged view of the EAS assembly of FIG. 3 folded over itself in a compact storage and transport condition.
Figure 7:
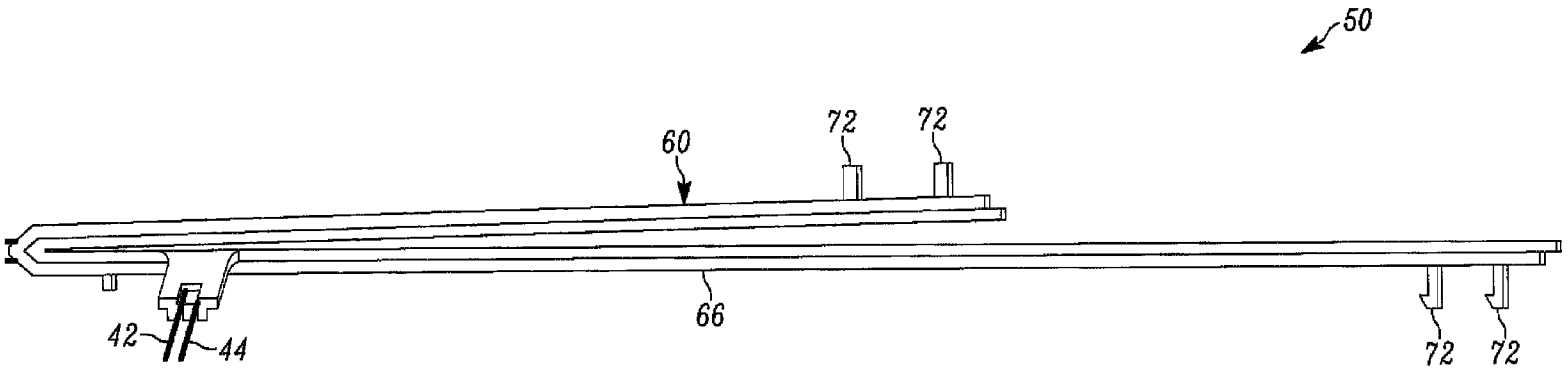
FIG. 7 is a side view of the folded EAS assembly of FIG. 6.
Figure 8:
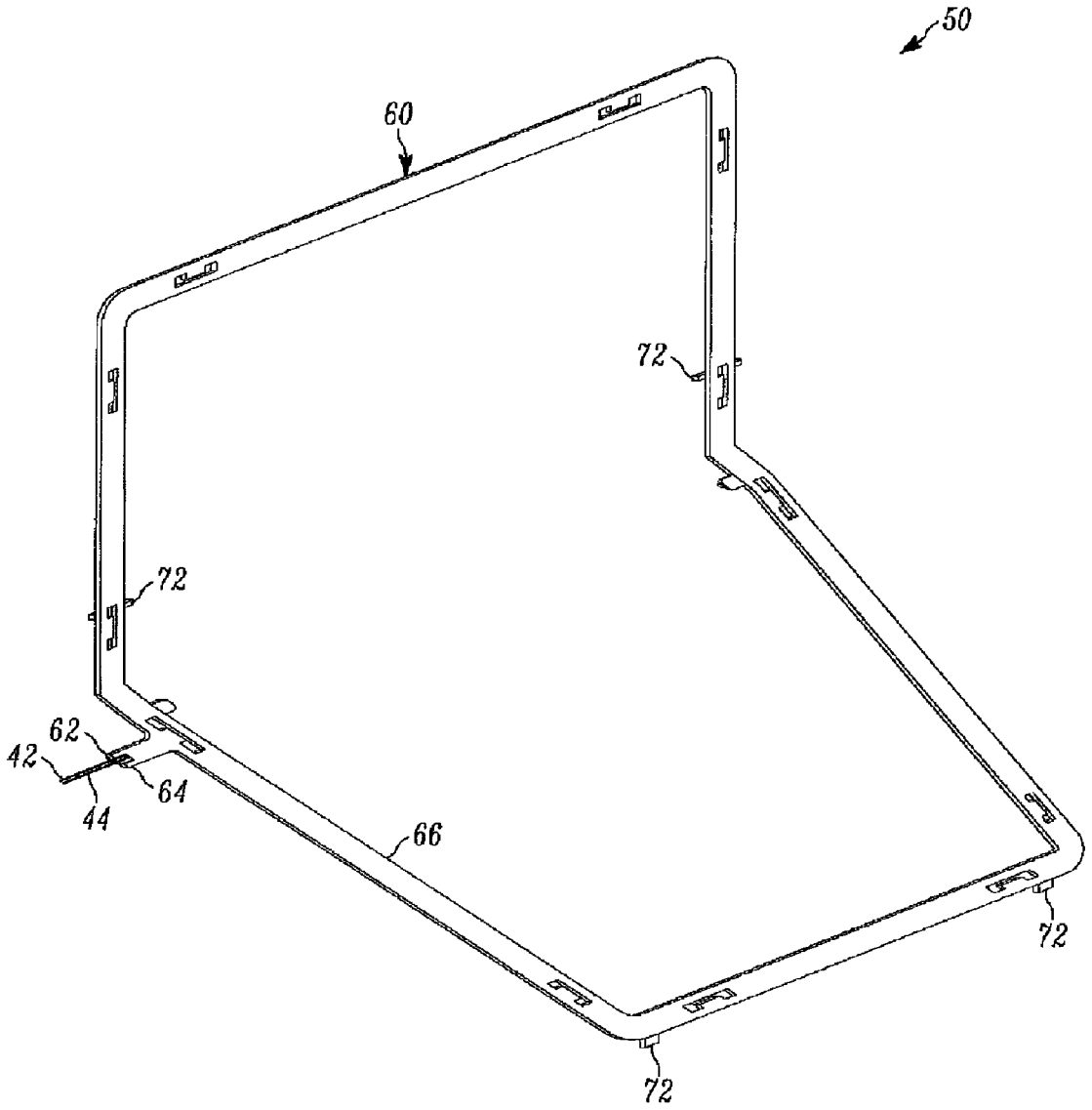
FIG. 8 is a perspective view of the EAS assembly of FIG. 3 folded over itself in an installation condition.
Figure 9:
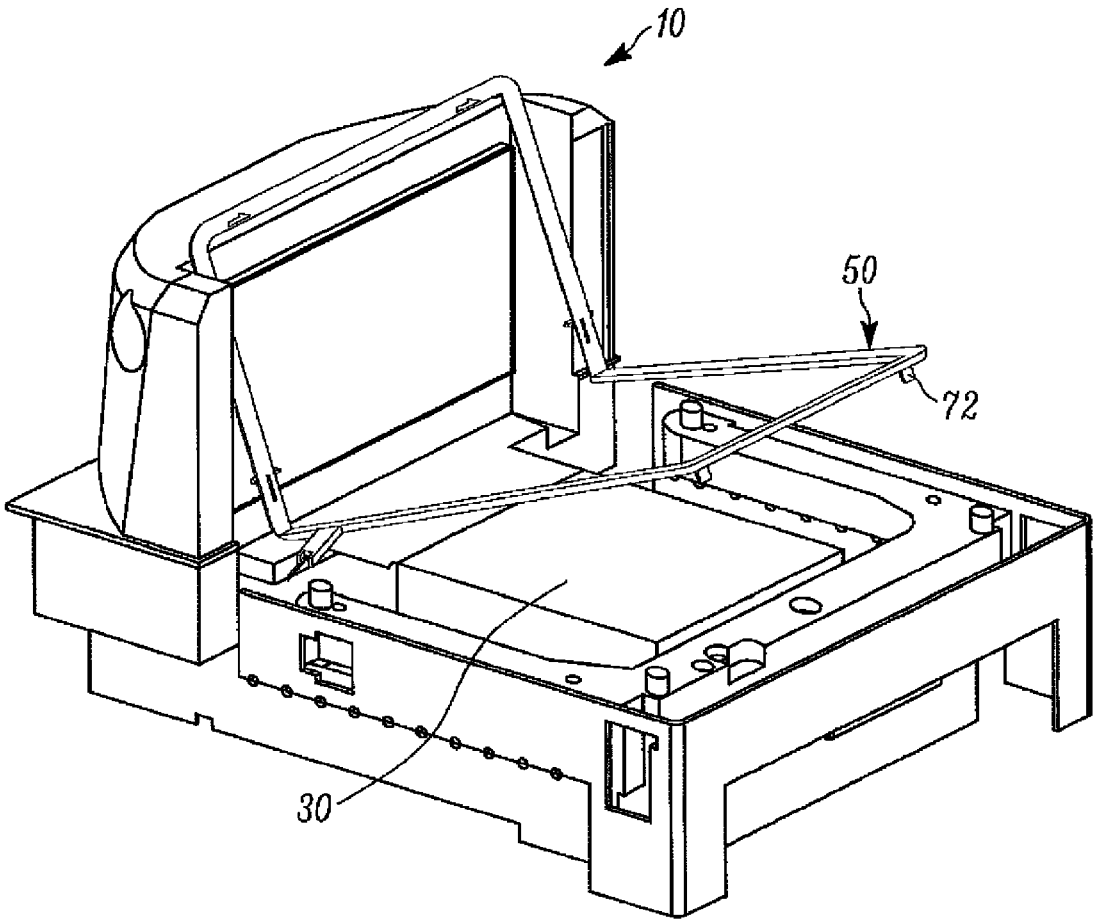
FIG. 9 is a perspective, exploded view of the EAS assembly of FIG. 3 during installation in the workstation of FIG. 2.

The carrier 60 has a hinge 70, preferably a living hinge, about which the carrier 60 and the supported antenna 40 are foldable. FIGS. 6-7 depict an upper portion of the EAS assembly 50 folded almost entirely flat onto a lower portion of the EAS assembly 50 to a compact condition in which the EAS assembly 50 may be conveniently stored and transported. FIG. 8 depicts the upper and lower portions of the EAS assembly 50 folded to a generally L-shaped condition in which the EAS assembly 50 may be conveniently installed in the workstation 10, as shown in FIG. 9.

Figure 10:
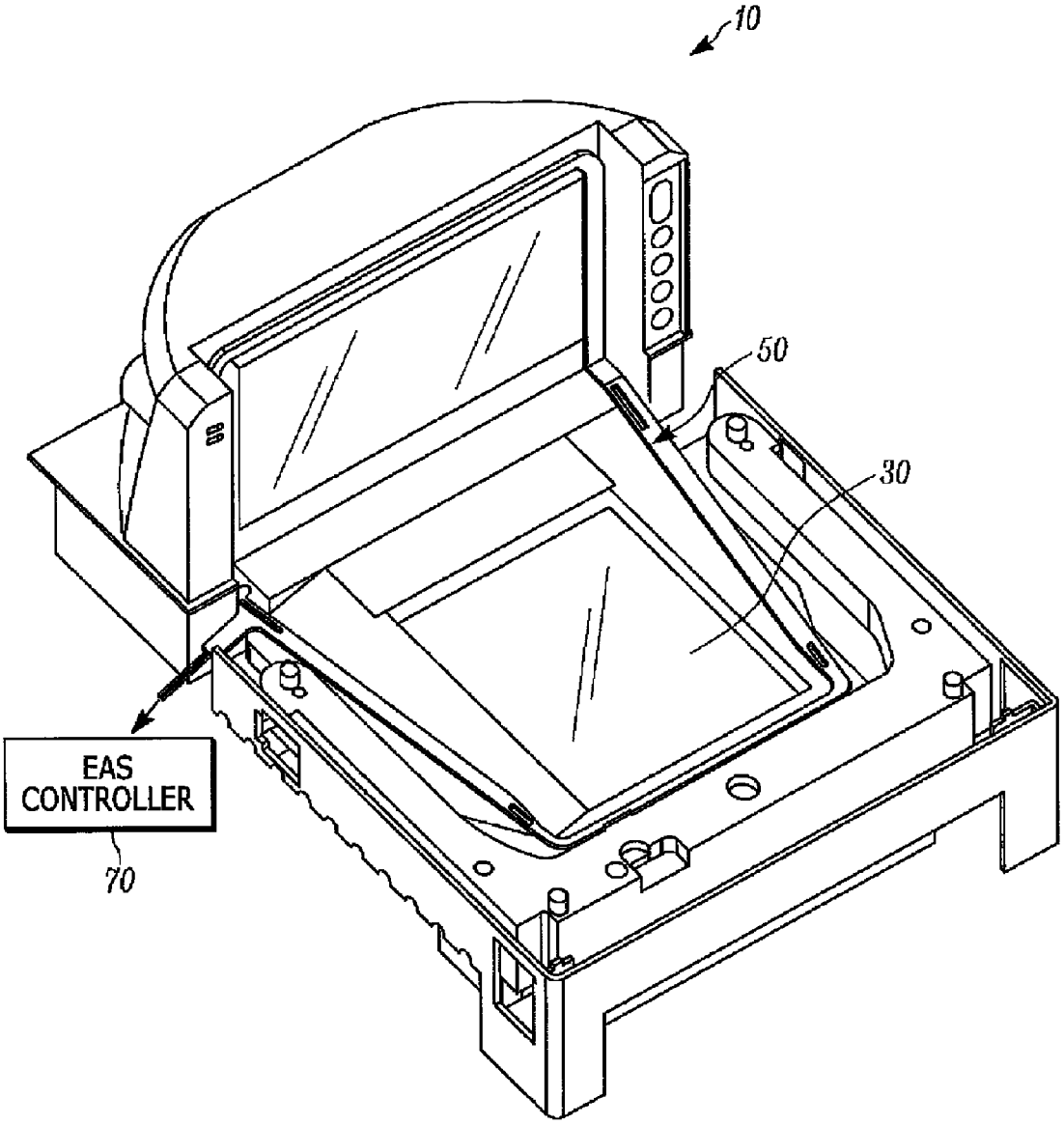
FIG. 10 is a perspective, exploded view of the EAS assembly of FIG. 3 after installation in the workstation of FIG. 2.
Figure 11:
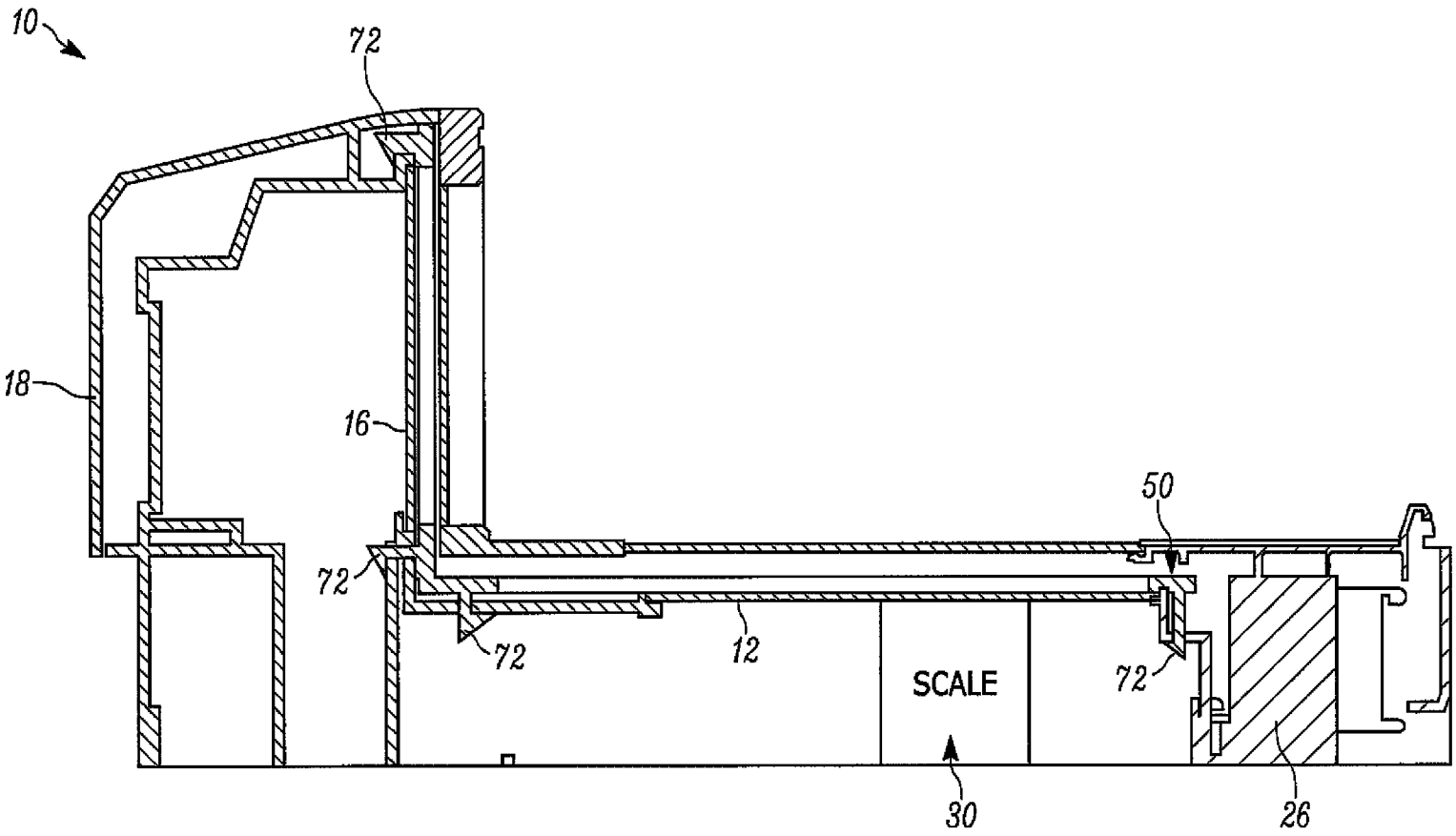
FIG. 11 is a sectional view of the EAS assembly of FIG. 3 after installation in the workstation of FIG. 2.

FIG. 10 depicts the L-shaped EAS assembly 50 after it has been installed in the predetermined position in the workstation 10. The loop 46 and the guard 66 surround the windows 12, 16 and/or the scale 30 in the predetermined position, and the feed lines 42, 44 and the guides 62, 64 extend linearly outwardly of the workstation in the predetermined position to an EAS controller 70, which operates to energize the antenna 40, preferably simultaneously with the reading of the symbols. Although the EAS assembly 50 can be merely placed in the predetermined position, it is preferable to provide the carrier 60 with integral, resilient legs 72 with enlarged heads for securely mounting the carrier and the supported antenna in the predetermined position in the workstation by snap action, as best seen in FIG. 11, or by any other type of fastener.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, contains a list of elements does not include only those elements, but may include other elements not expressly listed or inherent to such process, method, article, or apparatus. An element proceeded by "comprises . . . a," "has . . . a," "includes . . . a," or "contains . . . a," does not, without more constraints, preclude the existence of additional identical elements in the process, method, article, or apparatus that comprises, has, includes, or contains the element. The terms "a" and "an" are defined as one or more unless explicitly stated otherwise herein. The terms "substantially," "essentially," "approximately," "about," or any other version thereof, are defined as being close to as understood by one of ordinary skill in the art, and in one non-limiting embodiment the term is defined to be within 10%, in another embodiment within 5%, in another embodiment within 1%, and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors, and field programmable gate arrays (FPGAs), and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein, will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. An electronic article surveillance (EAS) assembly for installation in a workstation for processing products associated with targets to be electro-optically read, the assembly comprising:

a radio frequency (RF) antenna having a pair of RF feed lines and a conductive loop for generating an electromagnetic field to deactivate EAS tags associated with the products to be processed; and a protective carrier for supporting and protecting the antenna during the installation in a predetermined position in the workstation, the carrier having a hinge about which the carrier and the supported antenna are foldable.

2. The assembly of claim 1, wherein the carrier has a pair of guides of complementary contour to the feed lines for supporting the feed lines, and a guard of complementary contour to the loop for supporting the loop.

3. The assembly of claim 1, wherein the feed lines and the loop are constituted of a one-piece, flexible conductor; and wherein the carrier is constituted of an inflexible material and has a groove in which the flexible conductor is received and held.

4. The assembly of claim 1, wherein the carrier has legs for mounting the carrier and the supported antenna in the predetermined position in the workstation by snap action.

5. A workstation for processing products associated with targets to be electro-optically read, and for deactivating electronic article surveillance (EAS) tags associated with the products, the workstation comprising:

a housing for supporting a light-transmissive window through which the targets are electro-optically read; and an EAS assembly installable in a predetermined position in the housing, the EAS assembly including a radio frequency (RF) antenna having a pair of feed lines and a conductive loop for generating an electromagnetic field to deactivate the EAS tags, and a protective carrier for supporting and protecting the antenna during installation of the EAS assembly in the predetermined position in which the loop surrounds the window wherein the carrier has a hinge about which the carrier and the supported antenna are foldable.

6. The workstation of claim 5, wherein the carrier has a pair of guides of complementary contour to the feed lines for supporting the feed lines, and a guard of complementary contour to the loop for supporting the loop; and wherein the loop and the guard surround the window in the predetermined position, and wherein the feed lines and the guides extend outwardly of the housing in the predetermined position.

7. The workstation of claim 5, wherein the feed lines and the loop are constituted of a one-piece, flexible conductor; and wherein the carrier is constituted of an inflexible material and has a groove in which the flexible conductor is received and held.

8. The workstation of claim 5, wherein the carrier has legs for mounting the carrier and the supported antenna in the predetermined position in the housing by snap action.

9. The workstation of claim 6, and a scale for weighing the products, and wherein the loop and the guard surround the scale in the predetermined position.

10. The workstation of claim 6, wherein the housing has a horizontal bed for supporting the window, and an upright raised tower for supporting another window, and wherein the loop and the guard surround both windows in the predetermined position.

11. A method of installing an electronic article surveillance (EAS) assembly in a workstation for processing products associated with targets to be electro-optically read, the method comprising:

configuring a radio frequency (RF) antenna with a pair of RF feed lines and a conductive loop for generating an electromagnetic field to deactivate EAS tags associated with the products to be processed;

supporting and protecting the antenna with a protective carrier to constitute the EAS assembly;

folding the carrier and the supported antenna about a hinge; and installing the EAS assembly in a predetermined position in the workstation.

12. The method of claim 11, and configuring the carrier with a pair of guides of complementary contour to the feed lines for supporting the feed lines, and with a guard of complementary contour to the loop for supporting the loop.

13. The method of claim 11, and constituting the feed lines and the loop of a one-piece, flexible conductor; and constituting the carrier of an inflexible material; and receiving and holding the flexible conductor in a groove of the carrier.

14. The method of claim 11, and mounting the EAS assembly in the predetermined position in the housing by snap action.

15. The method of claim 12, wherein the processing of the products is performed by electro-optically reading the targets through a light-transmissive window on the workstation, and wherein the installing is performed by surrounding the window with the loop and the guard in the predetermined position.

16. The method of claim 12, wherein the processing of the products is performed by weighing the products with a scale in the workstation, and wherein the installing is performed by surrounding the scale with the loop and the guard in the predetermined position.

17. The method of claim 12, wherein the processing of the products is performed by electro-optically reading the targets through at least one of a pair of light-transmissive windows on the workstation, and wherein the installing is performed by surrounding the windows with the loop and the guard in the predetermined position.

* * * * *